US009221585B1

(12) United States Patent
Wang

(10) Patent No.: US 9,221,585 B1
(45) Date of Patent: Dec. 29, 2015

(54) CAP CLOSING STRUCTURE

(71) Applicant: Yeo-Ming Wang, Taipei (TW)

(72) Inventor: Yeo-Ming Wang, Taipei (TW)

( * ) Notice: Subject to any disclaimer, the term of this patent is extended or adjusted under 35 U.S.C. 154(b) by 0 days.

(21) Appl. No.: 14/476,280

(22) Filed: Sep. 3, 2014

(51) Int. Cl.
*A47G 19/22* (2006.01)
*B65D 41/02* (2006.01)
*B65D 41/26* (2006.01)

(52) U.S. Cl.
CPC ..... *B65D 41/02* (2013.01); *B65D 41/26* (2013.01)

(58) Field of Classification Search
CPC . B65D 47/066; B65D 51/242; B65D 47/0885
USPC ..... 215/236, 237, 235, 228, 229; 220/254.3
See application file for complete search history.

(56) References Cited

U.S. PATENT DOCUMENTS 6,279,773 B1 * 8/2001 Kiyota ..... A47G 19/2266 220/709
6,609,624 B2 * 8/2003 Goto ..... A47G 19/2266 220/259.1
6,991,126 B2 * 1/2006 Jackel ..... A47G 19/2266 220/259.1
7,059,490 B2 * 6/2006 Son ..... B65D 25/465 220/254.3
7,097,065 B2 * 8/2006 Yoneoka ..... A47G 19/2266 220/203.06
7,798,348 B2 * 9/2010 Sawyer ..... B65D 47/0809 215/237
8,376,173 B2 * 2/2013 Britto ..... A47G 19/2266 206/217
8,550,269 B2 * 10/2013 Lane ..... B65D 47/066 215/229
8,602,238 B2 * 12/2013 El-Saden ..... B65D 47/066 215/389
2005/0133475 A1 * 6/2005 Goto ..... B65D 47/0814 215/237

* cited by examiner

*Primary Examiner* — Steven A. Reynolds
*Assistant Examiner* — King M Chu
(74) *Attorney, Agent, or Firm* — Muncy, Geissler, Olds & Lowe, P.C.

(57) ABSTRACT

A cap closing structure which comprises the following components: an inner cover, each side of which is provided with a positioning base, a sliding space with an open located on the positioning base; two buttons, each of which is located on the sliding space, the button has a button base and a pressing portion connected with each other, a latching space is between the button base and the pressing portion, one side of the button base is a latching portion, a flexible member is behind and urges the button base; an outer cover, a rear end of which is pivotally connected with the inner cover, each side of the outer cover is internally equipped with a latching member; wherein the latching members are embedded in the two latching spaces, then the latching members latch the two latching portions.

9 Claims, 5 Drawing Sheets

CAP CLOSING STRUCTURE

BACKGROUND OF THE INVENTION

1. Field of the Invention

The present invention generally relates to a cap structure, more particularly to a cap closing structure that can effectively cover the opening with a reliable sealing structure.

2. Description of the Prior Art

Nowadays, modern outdoor activities are very popular, but outdoor drinking is a problem. For solving the problem, people often bring their own water bottles. According to the characteristics of water and the dynamic factors derived from carrier engaging in outdoor sports, some embarrassing situations such as water leakage to wet the backpack, human body, or other items may trouble users. FIG. 1 illustrates a schematic structural view of a cap closing structure in prior arts. The cap closing structure has a bottle 90, which has an inner cover 91 pivotally connected with an outer cover 92; a fastening structure is between the inner cover 91 and the outer cover 92 for fastening; and another button 93 is going to release the fastening strength in order to lift the outer cover 92 upwardly. Another patent, U.S. Pat. No. 8,550,269B2, further discloses that a button tunnel and an open portion shaped as tube; the button tunnel can slide to accommodate the button; the outer cover 92 has a fastening member. The fastening structure is between the fastening member and the button in order to fasten the outer cover and the inner cover. To press the button is to release the fastening member so as to lift the outer cover, whereby the user is able to enjoy the liquid in the bottle 90.

Although the prior art uses the fastening structure to fasten the outer cover 92 and the inner cover 91, some shortcomings are shown still. For instance, the button tunnel and the button are located in front of the inner cover, and the button and the fastening member of the outer cover construct the fastening structure. In other words, as there is only one fastening structure at the front portion of the bottle, if the fastening force between the outer cover and the inner cover is not strong enough, leakage happens. Therefore, how to overcome the shortcomings is an important issue to people skilled in the art.

SUMMARY OF THE INVENTION

The main objective of the present invention is to provide a cap closing structure which enhances the fastening force between an outer cover and an inner cover thereof a bottle with this cap closing structure can be easily used without leakage problems.

To approach the aforesaid objective, a cap closing structure comprises the following components is adopted: an inner cover, each side of which is provided with a positioning base, and there is a sliding space with an opening located on the positioning base; a rear end of the positioning base is connected to a rear wall; a first button groove seat is located on the outer rim of the inner cover and below the positioning base; the first button groove seat has an accommodating space; two buttons, respectively located in the sliding space of the positioning base, either button has a button base and a pressing portion connected with each other, a latching space is between the button base and the pressing portion, on one side of the button base adjacent to the latching space there is a latching portion, a flexible member is behind and urges the button base, the pressing portion is located in the accommodating space of the first button groove seat; an outer cover, a rear end of the outer cover is pivotally connected with the inner cover, each side of the outer cover is internally equipped with a latching member; a front portion of an inner portion of the outer cover is equipped with a pressing member; wherein the latching members are embedded in the two latching spaces, then the latching members latch the two latching portions in order to fasten the outer cover and the inner cover together.

In the aforementioned structure, the inner portion of the inner cover contains an inner cover space, and the rear portion of the inner cover is provided with a pivot base, which has a pivot hole on its each side and a groove in front of it.

In the aforementioned structure, a water outlet is located roughly on the center of the inner cover, on the said water outlet there is a water hole connected with the inner cover space, and the front portion of the water outlet has an air hole connected with the inner cover space.

In the aforementioned structure, each end of the positioning base is equipped with a sliding groove that is connected with the sliding space; at the rear end of the positioning base there is a rear wall that urges the flexible member.

In the aforementioned structure, a connecting arm is located between each side of the button base and the pressing portion; the latching space is formed between the two connecting arms; the button base has a plurality of urging blocks that are corresponding to the two sliding grooves; a rear portion of the button base has an urging pillar that fixes the flexible member.

In the aforementioned structure, an inner portion of the outer cover has an outer cover space; a rear portion of the outer cover is equipped with a pivot groove base; the pivot groove base has a pivot groove space and two pivot holes located respectively at each side of the pivot groove space.

In the aforementioned structure, each side of the outer cover has a second button groove seat that is corresponding to the first button groove seat, and the second button groove seat has a reserving accommodating space.

In the aforementioned structure, a bottom of the latching member has a latching portion; a front portion of the outer cover space of the outer cover is equipped with a pressing plate.

In the aforementioned structure, the cap closing structure further comprises a bottle member with a bottle opening that is screwed into the inner cover.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE PREFERRED EMBODIMENTS

The following preferred embodiments and figures will be described in detail as how to achieve the aforesaid objectives.

Figure 1:
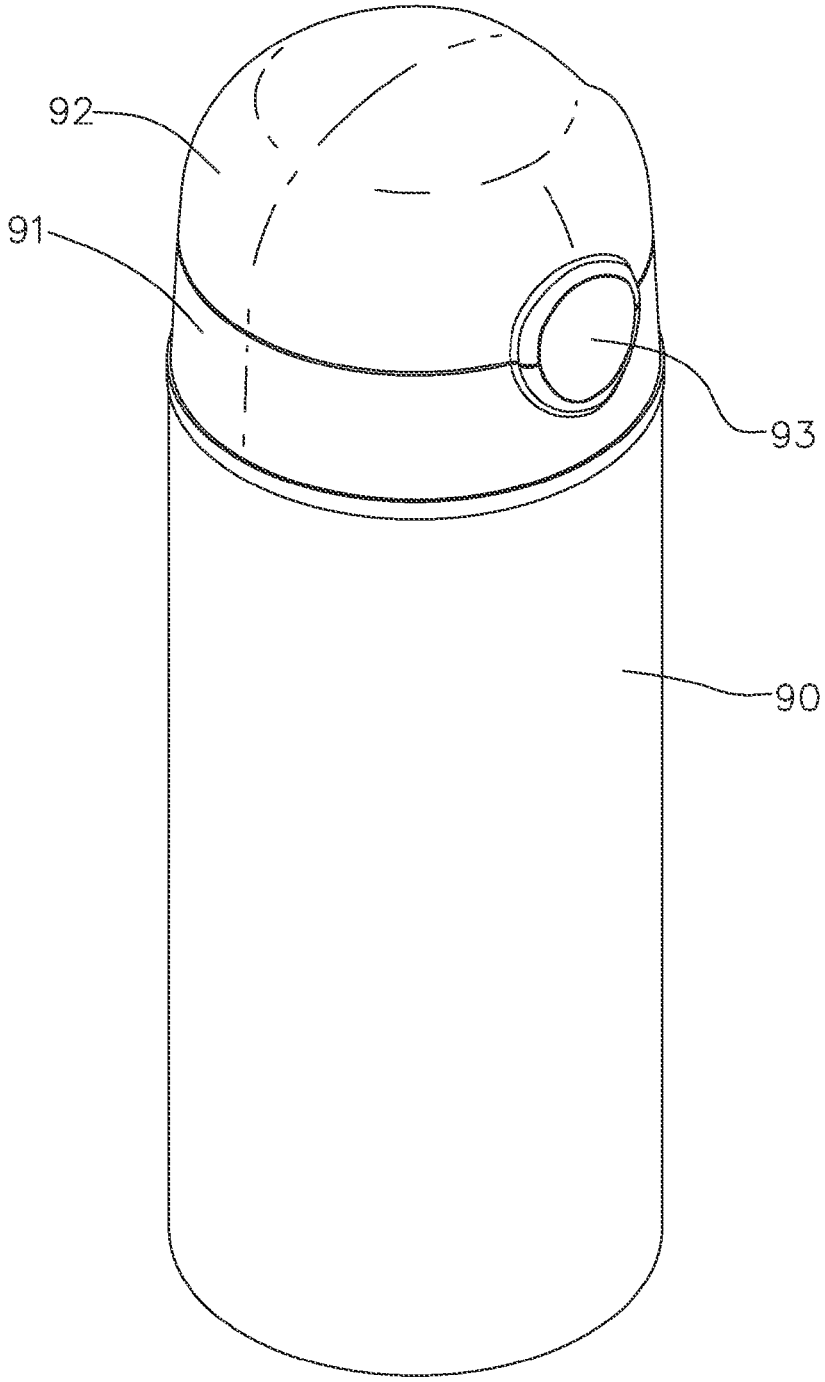
FIG. 1 ( Prior Art )
FIG. 1 illustrates the sealing mechanism of a conventional design.
Figure 2:
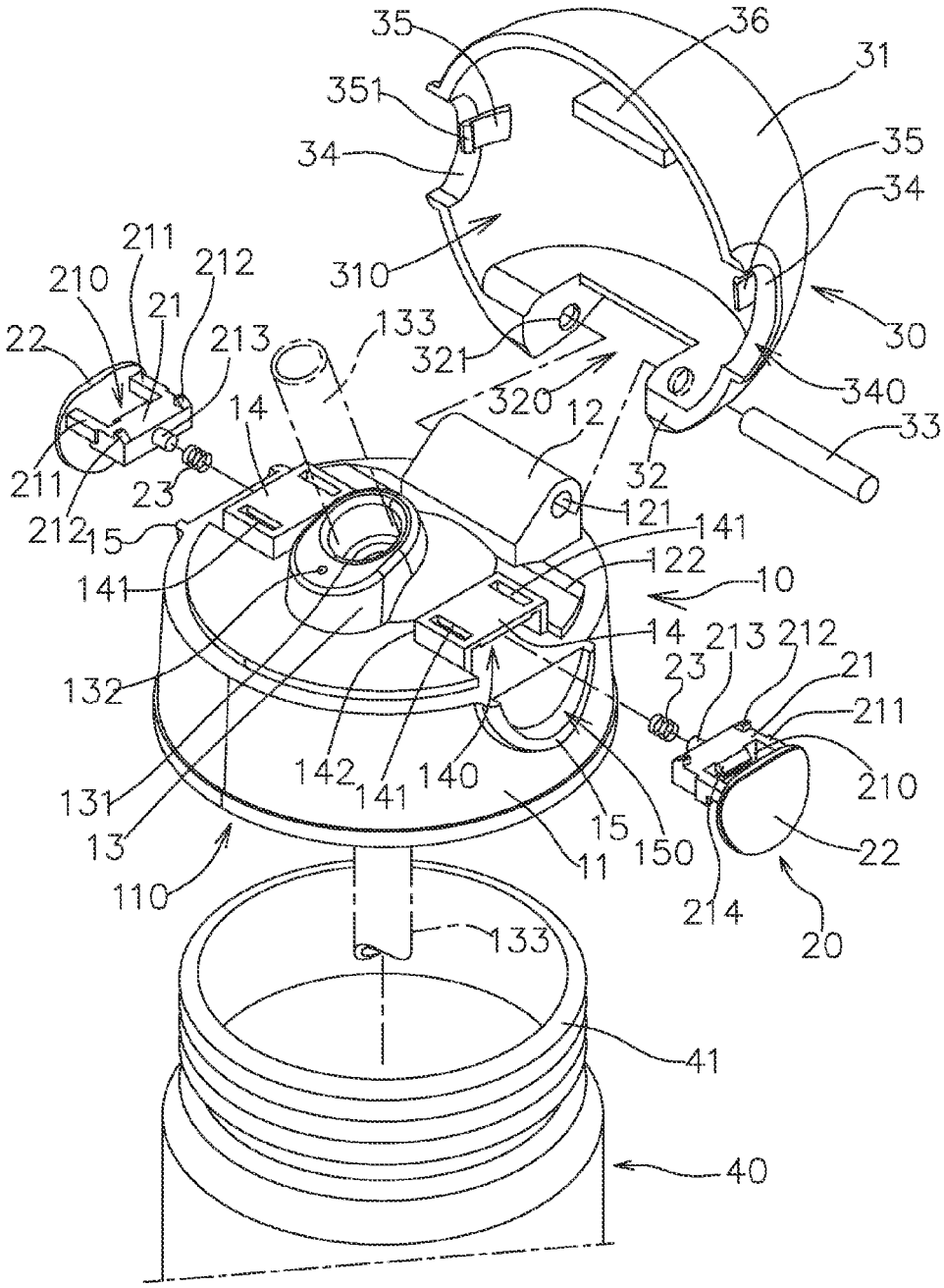
FIG. 2 illustrates the breakdown structure of the present invention.
Figure 3:
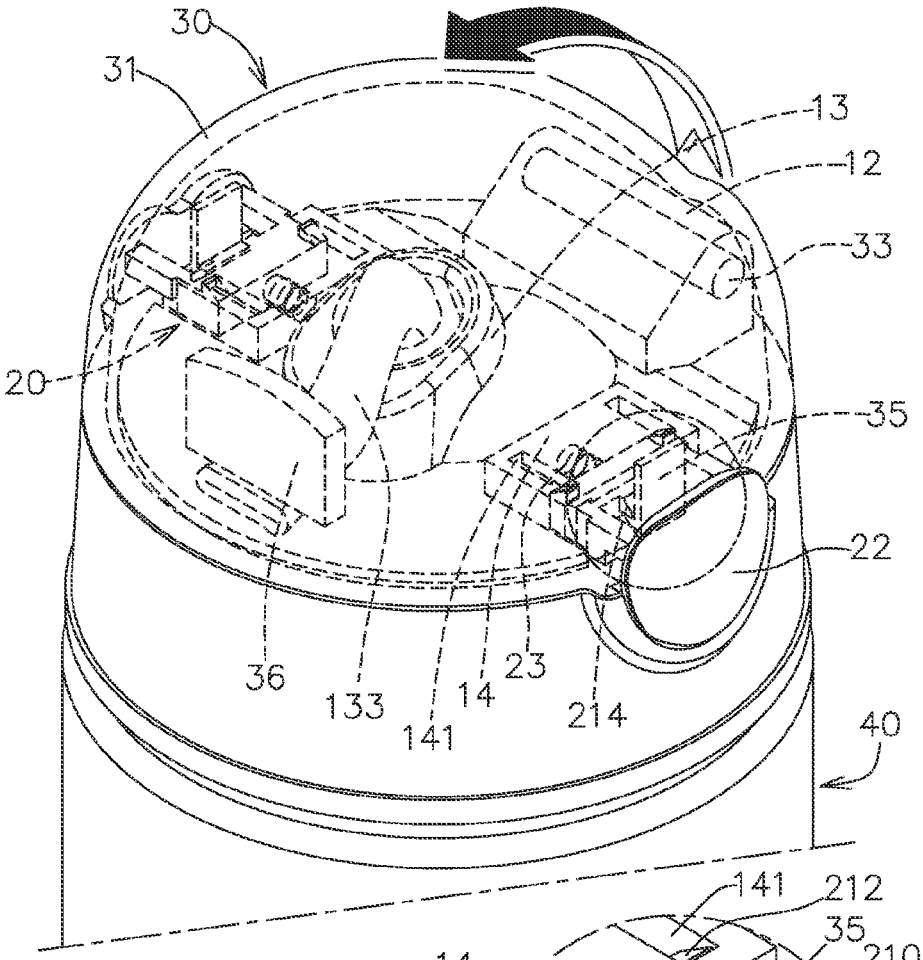
FIG. 3 illustrates the sealing mechanism of the present invention.
Figure 4:
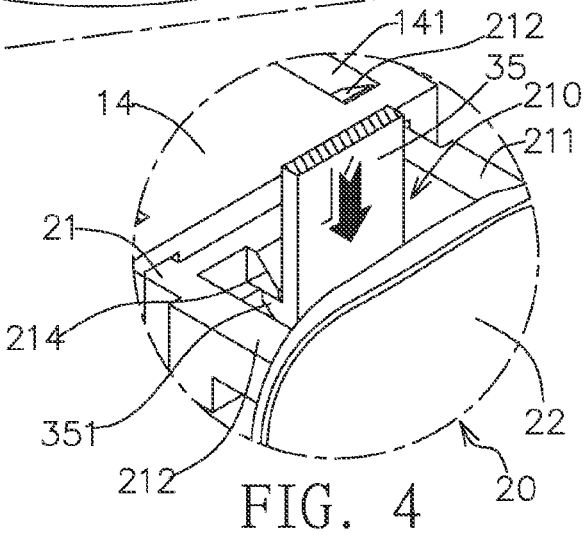
FIG. 4 illustrates the partial view of the latching mechanism used in the present invention.

As shown in FIG. 2 to FIG. 4, i.e. a schematic breakdown view of the present invention, a schematic covering view of the present invention and a partial schematic latching view of the present invention. The cap closing structure provided by the present invention has: an inner cover device 10, a fastening device 20 and an outer cover device 30; wherein the inner cover device 10 has an inner cover 11 with an inner cover space 110, a rear portion (based on the direction of FIG. 2) of the inner cover 11 is provided with a raised pivot base 12, each side of the pivot base 12 has a pivot hole 121, a groove 122 is in front of the pivot base 12 in order to enhance the surface strength of the inner cover 11; a water outlet 13 is provided roughly around the center of the inner cover 11, the water outlet 13 has a water hole 131 connected with the inner cover space 110, the water hole 131 has an outlet tube 133 preferably made by a flexible material, the front portion of the water outlet 13 is downwardly tilted in order to let the outlet tube 133 be forwardly tilted for conveniently drawing, a front portion of the water outlet 13 (the outlet tube 133) has an air hole 132 that is connected with the inner cover space 110; each side of the inner cover 11 is provided with a positioning base 14, a sliding space 140 with an open is located on the positioning base 14, each of two ends of the positioning base 14 is equipped with a sliding groove 141 that is connected with the sliding space 140, a rear end of the positioning base 14 is a rear wall 142; further, a first button groove seat 15 is at an outer rim of the inner cover 11 and is corresponding to and below the positioning base 14, as the first button groove seat 15 has an accommodation space 150.

The fastening device 20 has two buttons, both have a button base 21 and a pressing portion 22; a connecting arm 211 between each side of the button base 21 to connect with the button base 21 and the pressing portion 22 respectively; a latching space 210 formed between the two connecting arms 211; one external side of the button base 21 adjacent to the latching space 210 forms a latching portion 214. Optionally, the upper portion of the button base 21 has a plurality of urging blocks 212 that are corresponding to the two sliding grooves 141; a rear portion of the button base 21 has an urging pillar 213, a spring 23 (or other flexible members) female-connects with the urging pillar 213. The button base 21 of the button is located on the sliding space 140 of the positioning base 14, and then the urging block 212 is in the sliding groove 141, so that the urging block 212 is able to slide back and forth in the sliding groove 141, and the button taken off from the first button groove seat 15 is avoided as well; the spring 23 on the urging pillar 213 is against to the rear wall 142 of the positioning base 14 in order to provide a recovery flexible force while re-pressing the button; in the meantime, the pressing portion 22 is located on the accommodating space 150 of the first button groove seat 15.

The outer cover device 30 has an outer cover 31. An inner portion of the outer cover 31 has an outer cover space 310, a rear portion of the outer cover 31 is provided with a pivot groove base 32, the pivot groove base 32 has a pivot groove space 320 and two pivot holes 321, wherein each of the two pivot holes 321 is at each side of the pivot groove space 320; each side of the outer cover 31 has a second button groove seat 34 that is corresponding to the first button groove seat 15, the second button groove seat 34 has a reserving space 340, each side of the outer cover 31 is internally equipped with a latching member 35, a bottom of the latching member 35 has a latching portion 351, a front portion of the outer cover space 310 of the outer cover 31 with a pressing plate 36. In order to cover the outer cover device 30 on the inner cover 11, the pivot groove base 32 of the outer cover 31 shall be corresponding to the pivot base 12 of the inner cover 11, that is, a pivot rod 33 is inserted through the pivot hole 321 and the pivot hole 121, so that the outer cover 31 is able to swing up and down on the inner cover 11.

Furthermore, there is a bottle member 40 which has a bottle open 41. The inner cover 11 is connected with the bottle open 41 of the bottle member 40 while in assembling. For instance, the bottle open 41 is screwed into the inner cover 11.

Please refer to in FIG. 3 and FIG. 4, i.e. a schematic covering view of the present invention and a partial schematic view of fastening of the present invention. When the outer cover 31 covers on the inner cover 11, each of the two latching portions 351 of the two latching members 35 is correspondingly embedded into each of the two latching spaces 210 of the two buttons, therefore, each of the two latching portions 351 of the two latching members 35 fastens each of the two latching portions 214 of the two buttons in order to let the outer cover 31 tightly cover on the inner cover 11. Meanwhile, the pressing member 36 of the outer cover 31 may restrain the outlet tube 133 so as to seal the air hole 132.

Figure 5:
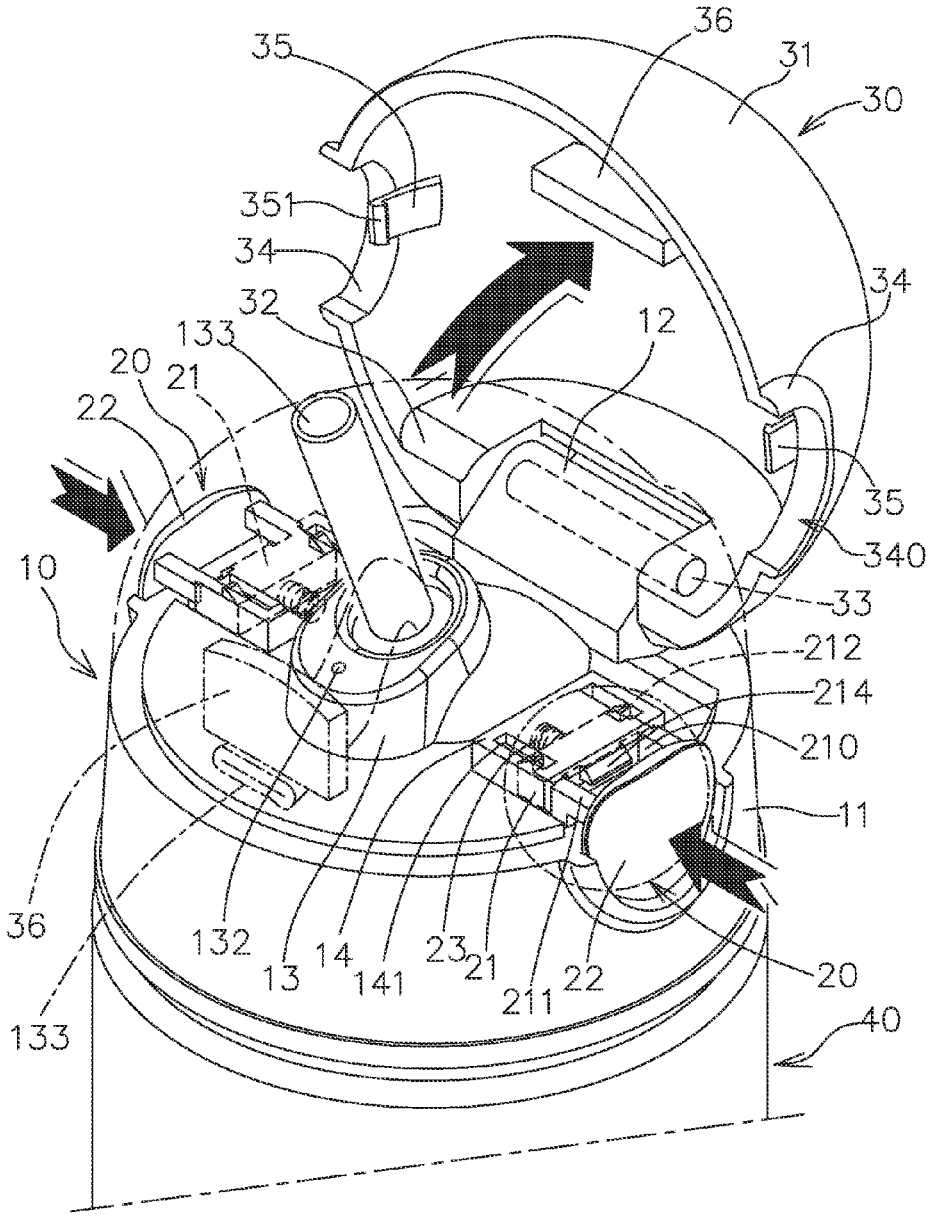
FIG. 5 illustrates the push-to-release mechanism of the present invention.
Figure 6:
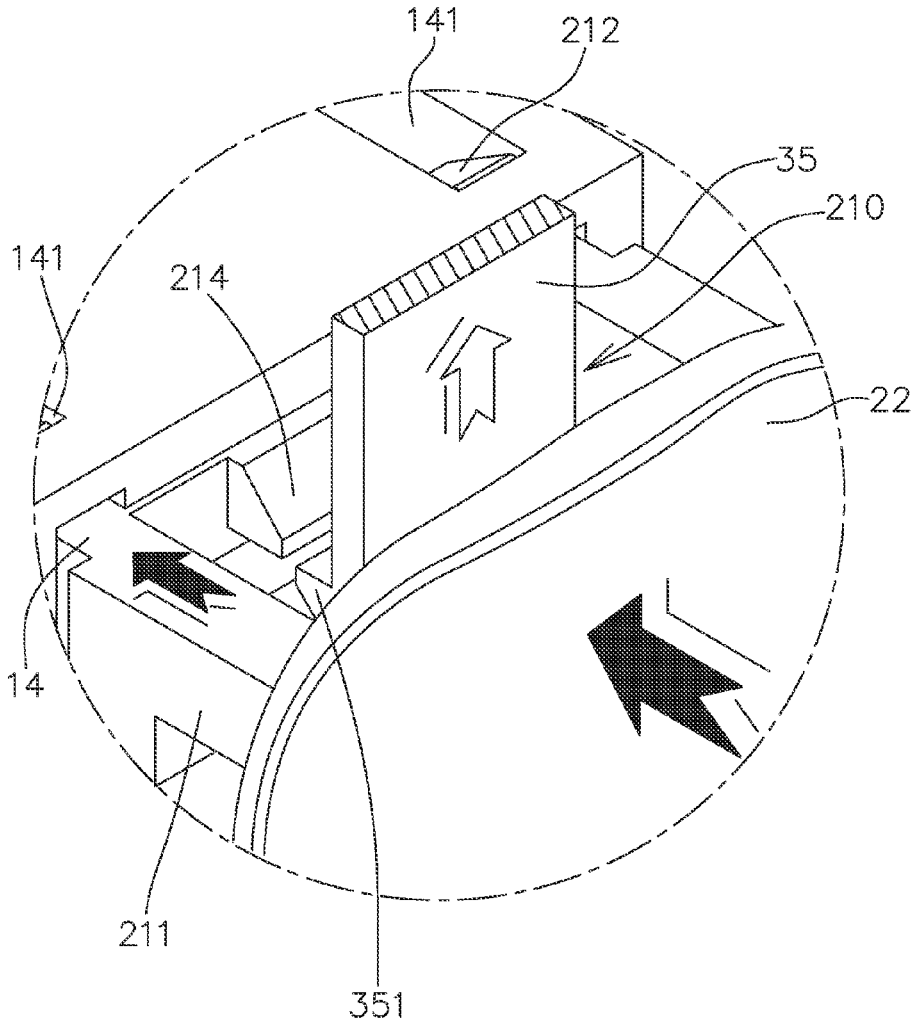
FIG. 6 illustrates the partial view of the push-to-release mechanism of the present invention.

As shown in FIG. 5 and FIG. 6, i.e. a schematic view of releasing of the present invention and a partial schematic view of releasing of the present invention. While in release, each of the buttons (the pressing portions 22) of the two sides of the inner cover 11 can be pressed so as to move the button bases 21 inwardly in the sliding spaces 140 for moving the two connecting arms 211 backwardly, so that the two urging blocks 212 move along the two sliding grooves 141. In the meantime, the two latching portions 214 release the latching members 35 (the latching portions 351) in order to lift the outer cover 31 for gaining water or soda water in the bottle member 40.

When the buttons (the pressing portions 22) of the two sides of the inner cover 11 are released, the two springs 23 pushes the buttons (the button bases 21) via flexible forces in order to let the pressing portions 22 move back to original (surface) positions of the first button groove seat 15 and the second button groove seat 34 for next usage.

The present invention provides a cap closing structure. That is, the fastening devices placed on the two sides of the inner cover are able to enhance the fastening force between the outer cover and the inner cover. Hence, a bottle with such cap closing structure can be dynamically used without worrying leakage.

The aforementioned cases have demonstrated that the present invention is a better solution in those cases; however, the application potential of the present invention is not limited to those cases. As long as it is somehow related to the know-how revealed herein, any variation or modification to such structure shall still be considered within the coverage of patent protection.

What is claimed is:

1. A cap closing structure, comprising:

an inner cover, each side of the inner cover is provided with a positioning base, an opened sliding space located on the said positioning base, a rear wall behind the rear end of the positioning base, a first button groove seat being at an outer rim of the inner cover and being corresponding to and below the positioning base, the first button groove seat having an accommodation space;

two buttons, each of the two buttons located in the sliding space of the positioning base, the button having a button base and a pressing portion that are connected with each other, a latching space between the button base and the pressing portion, one side of the button base adjacent to the latching space being a latching portion, a flexible member being behind and urging the button base, the pressing portion located in the accommodating space of the first button groove seat; and an outer cover, a rear end of the outer cover pivotally connected with the inner cover, each side of the outer cover internally equipped with a latching member, a front portion of an inner portion of the outer cover with a pressing member;

wherein the latching members are embedded in the two latching spaces, then the latching members latching the two latching portions in order to fasten the outer cover and the inner cover together.

2. The cap closing structure according to claim 1, wherein an inner portion of the inner cover has an inner cover space, a rear portion of the inner cover with a pivot base, each side of the pivot base having a pivot hole, a groove in front of the pivot base.

3. The cap closing structure according to claim 2, wherein a water outlet is approximately located on a central portion of the inner cover, the water outlet having a water hole that is connected with the inner cover space, a front portion of the water outlet having an air hole that is connected with the inner cover space.

4. The cap closing structure according to claim 1, wherein each of two ends of the positioning base has a sliding groove that is connected with the sliding space, a rear end of the positioning base being a rear wall that urges the flexible member.

5. The cap closing structure according to claim 4, wherein a connecting arm is between each side of the button base and the pressing portion, the latching space being formed between the two connecting arms, the button base having a plurality of urging blocks that are corresponding to the two sliding grooves, a rear portion of the button base having an urging pillar that fixes the flexible member.

6. The cap closing structure according to claim 1, wherein an inner portion of the outer cover has an outer cover space, a rear portion of the outer cover with a pivot groove base, the pivot groove base having a pivot groove space and two pivot holes, wherein each of the two pivot holes is at each side of the pivot groove space.

7. The cap closing structure according to claim 1, wherein each side of the outer cover has a second button groove seat that is corresponding to the first button groove seat, the second button groove seat having a reserving space.

8. The cap closing structure according to claim 6, wherein a bottom of the latching member has a latching portion, a front portion of the outer cover space of the outer cover with a pressing plate.

9. The cap closing structure according to claim 1 further comprising a bottle member, the bottle member having a bottle open that is screwed into the inner cover.

* * * * *